US007048347B1

(12) United States Patent
Liu

(10) Patent No.: US 7,048,347 B1
(45) Date of Patent: May 23, 2006

(54) TOOL CABINET WITH A POSITIONING DEVICE FOR DRAWERS

(76) Inventor: Jung-Feng Liu, No. 290, Da Lin Rd., Da Ya Hsiang, Taichung Hsien (TW)

( * ) Notice: Subject to any disclaimer, the term of this patent is extended or adjusted under 35 U.S.C. 154(b) by 0 days.

(21) Appl. No.: 11/194,664

(22) Filed: Aug. 2, 2005

(51) Int. Cl.
*A47B 88/00* (2006.01)
*A47B 95/02* (2006.01)

(52) U.S. Cl. ..... 312/332.1; 312/333

(58) Field of Classification Search ..... 312/330.1, 312/332.1, 333, 319.1, 348.4; 70/85; 292/336.3
See application file for complete search history.

(56) References Cited

U.S. PATENT DOCUMENTS 5,292,191 A * 3/1994 Slivon ..... 312/332.1
5,403,139 A * 4/1995 Slivon et al. ..... 312/332.1
6,527,353 B1 * 3/2003 Bradfish et al. ..... 312/332.1
6,547,289 B1 * 4/2003 Greenheck et al. ..... 292/126
6,851,286 B1 * 2/2005 Dube et al. ..... 70/81

FOREIGN PATENT DOCUMENTS

DE 3231432 * 4/1983

* cited by examiner

*Primary Examiner*—James O. Hansen
(74) *Attorney, Agent, or Firm*—Bacon & Thomas PLLC

(57) ABSTRACT

A cabinet has a positioning device including at least one locating device. Each locating device has a fastener, a fixture group, two slots and two first holes. The fastener has a side board and a bottom board forming an L-shape, and a notch is defined in the bottom board. The fixture group includes a bridge member and a lever, and the bridge member is connected with an arm. A hook is formed in the distal end of the arm, which can further hitch itself to the channel of the fastener. When the handle of the drawer is swayed outward by the user and the hook will escape from the channel, and the drawer will open.

7 Claims, 6 Drawing Sheets

TOOL CABINET WITH A POSITIONING DEVICE FOR DRAWERS

BACKGROUND OF THE INVENTION

1. Field of the Invention

The present invention relates to a tool cabinet, and particularly relates to a tool cabinet with a positioning device for drawers to prevent the drawers from undesirably sliding out.

2. Description of Related Art

A tool cabinet is used for storing various tools, and the tool cabinet with wheels can be moved conveniently if necessary. Normally, a slide track is mounted between the drawers and the cabinet to facilitate opening and closing of the drawers. However, the drawers slide out too easily when the tool cabinet is moving such that the tools may be scattered over a floor, and worse, the center of gravity of the tool cabinet might be shifted such that it tips over and endangers workers. In order to enhance safety, the drawers are designed to be locked. As shown in FIG. 6, two slide tracks (62) are respectively mounted on two opposite walls of a tool cabinet (61), and a drawer (63) has two horizontal flanks (631) and two vertical rods (632) extending respectively from two horizontal flanks (631) of the drawer (63), which slide in the tracks (62). A hook (70) with a first end and a second end is pivotally mounted on one flank (631) with a resilient member (71) pressing the hook (70) downward, and the first end of the hook (70) is mounted through a front of the drawer (63). The first end of the hook (70) is connected with a pressing member (72). The slide track (62) has a slot (621) to receive the second end of the hook (70).

When the drawer (63) is pushed into the cabinet (61), the second end of the hook (70) will be pressed by the resilient member (71) and fastened in the slot (621). If it is necessary to open the drawer (63), the pressing member (72) is pushed down by an operator using one hand, so the second end of the hook (70) will be raised to escape from the slot (621), then, a handle (633) is pulled by the operator's other hand to open the drawer.

The above drawer design is able to fasten the drawer (63) when it is closed. However, both hands are required to open the drawer (63) which is inconvenient when in a workshop. Furthermore, only one side of the drawer (63) is fastened and that side endures the total force from the drawer (63), whereby the elements are damaged easily. What is more, the overall structure is complex such that it is unnecessarily expensive to fabricate and inclined to malfunction.

Therefore, the invention provides a tool cabinet to mitigate or obviate the aforementioned problems.

SUMMARY OF THE INVENTION

The main objective of the present invention is to provide a tool cabinet with a positioning device for drawers, which overcomes the defects in prior art and has a simple structure.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
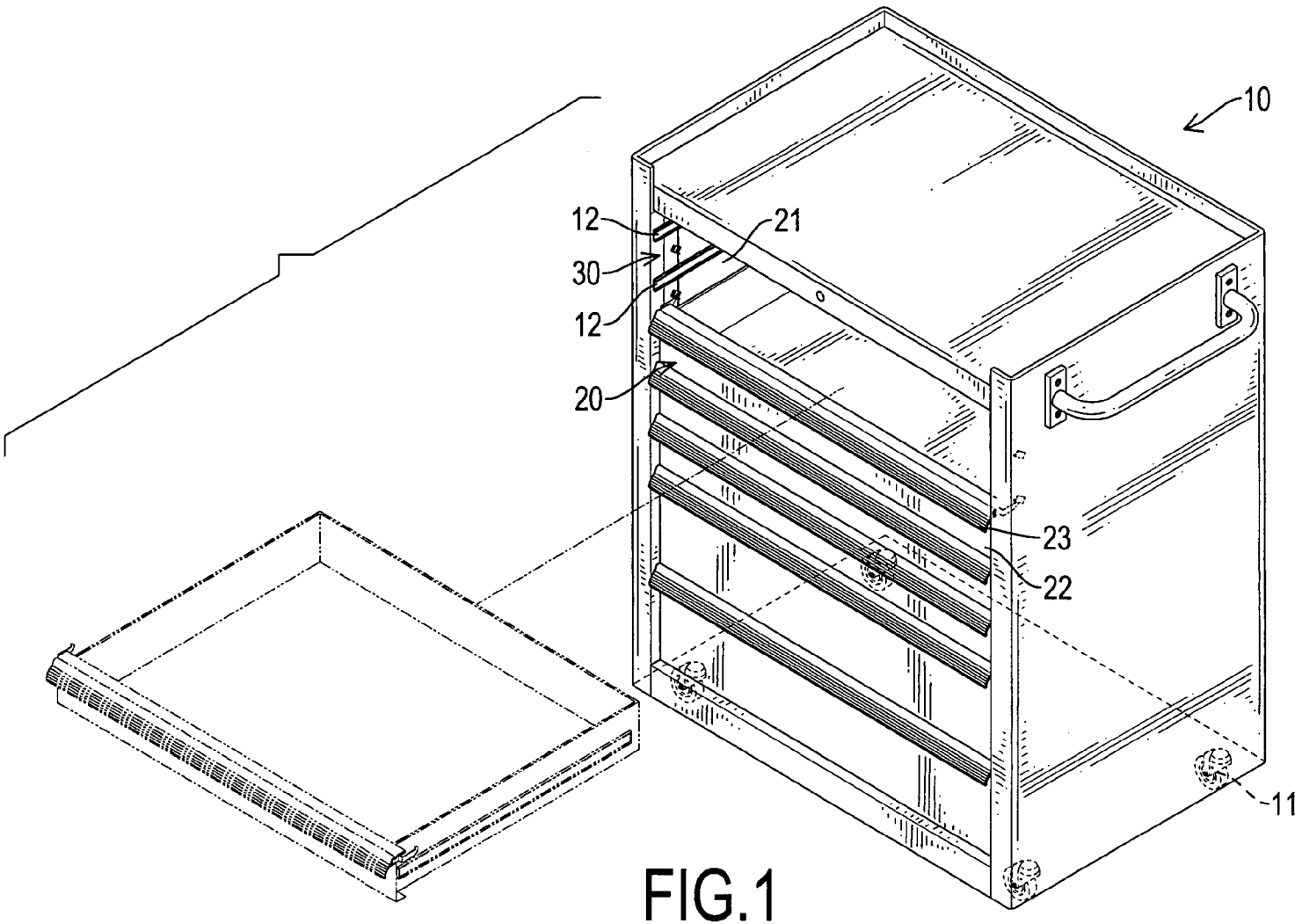
FIG. 1 is a perspective view of a cabinet in accordance with this invention, with a drawer removed.
Figure 2:
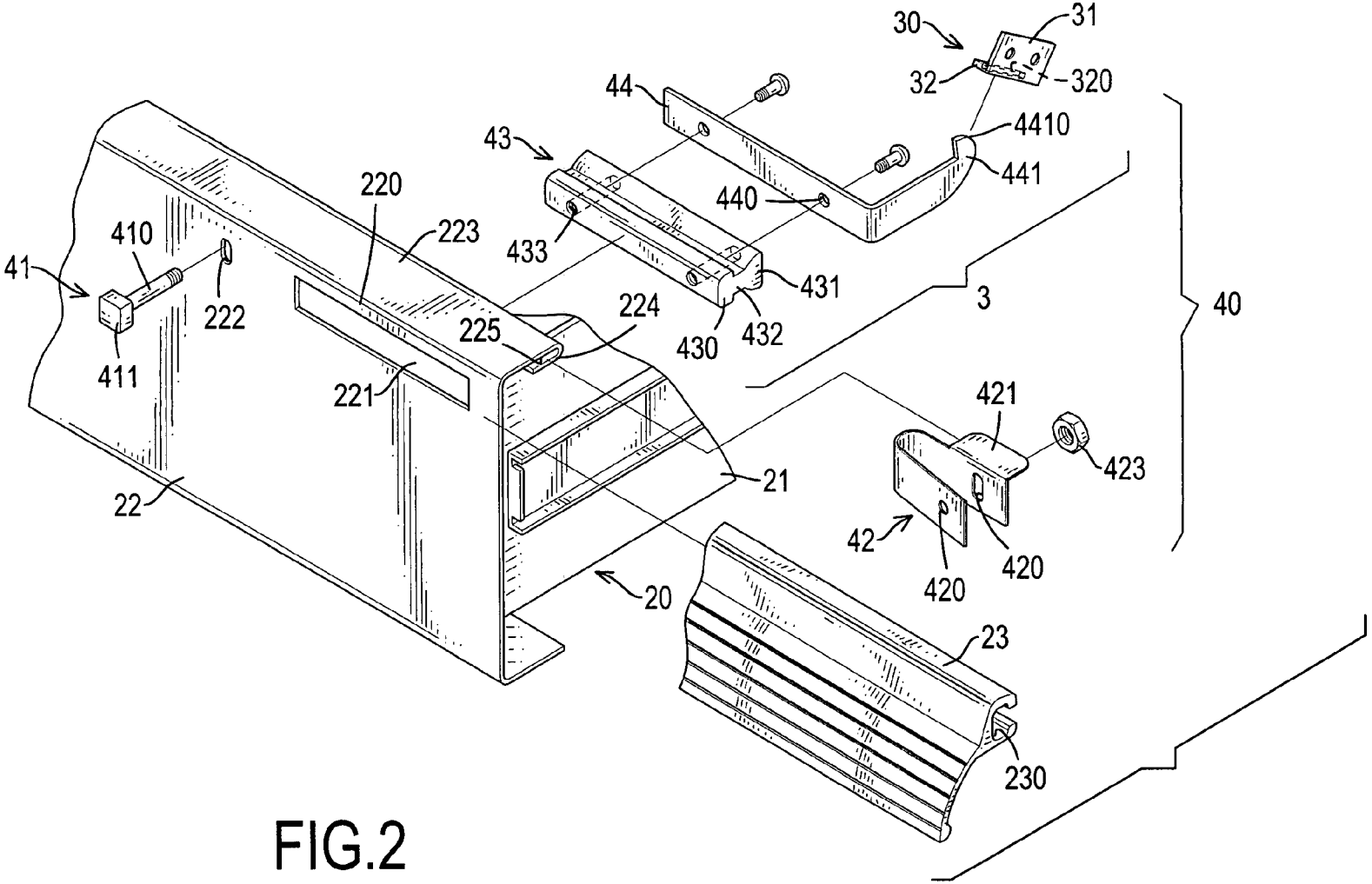
FIG. 2 is an exploded view of a drawer in accordance with this invention.
Figure 3:
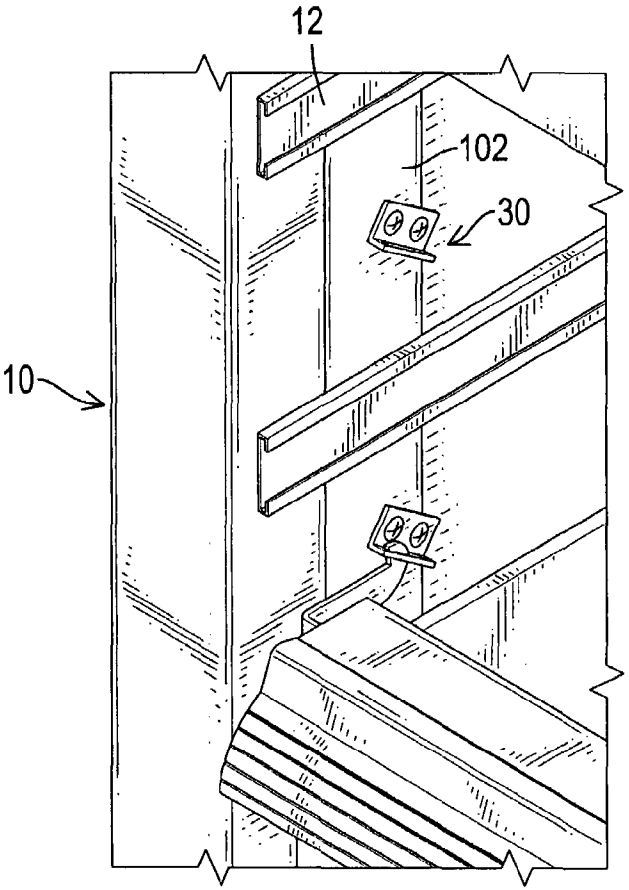
FIG. 3 is a perspective view of a fastener mounted in the cabinet in accordance with this invention.
Figure 4:
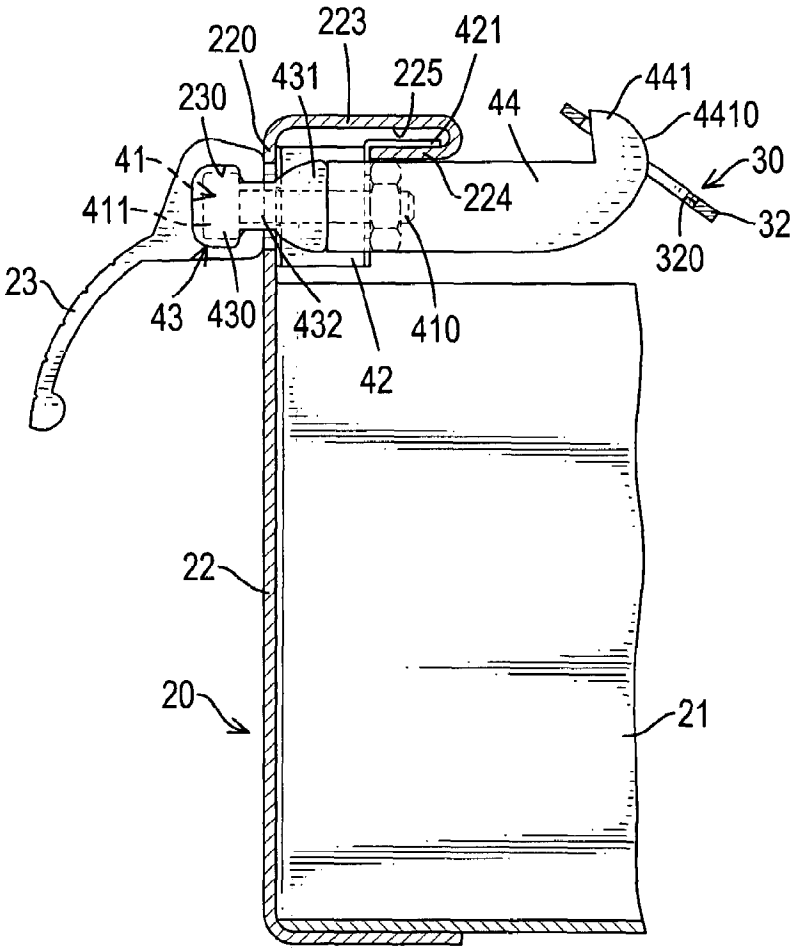
FIG. 4 is a partial view in cross-section showing the fastening status of the fastener in accordance with this invention.

With reference to FIG. 1 and FIG. 2, a cabinet (10) has a body with an open front, multiple slide tracks (12) are mounted at inner walls of two opposite side faces of the body, and at least one drawer (20) is mounted between two opposite slide tracks (12). To fasten the drawers (20) in the cabinet (10), a positioning device is provided and comprises multiple locating devices (3) corresponding respectively to the drawers (20). Each locating device (3) is mounted between a corresponding drawer (20) and the inner walls of two opposite side faces. Multiple wheels (11) are mounted at a bottom of the cabinet (10).

With reference to FIGS. 1–4, the drawer (20) has two side walls (21), a front wall (22), and a handle (23) crossing the front wall (22) transversely. Each locating device (3) includes a fastener (30), a fixture group (40) mounted in the front wall (22) of the corresponding drawer (20). Two slots (221) and two first holes (222) are defined in the front wall (22). The fastener (30) is securely attached to the body and comprises a side board (31) and a bottom board (32) together forming an L-shape and is fixed at a pole (102). The bottom board (32) is tilted with respect to the drawer (20) to facilitate the clasp of the fixture group (40). A notch (320) is defined along the bottom board (32).

The front wall (22) of the drawer (20) is higher than the side wall (21) and forms a connection member (220). The connection member (220) extends to the inside of the drawer (20) and forms a top (223). A hooked member (224) is formed at a distal end of the top (223), and a recess (225) is defined therein.

The fixture group (40) includes a lever (41), a resilient clamp (42), a bridge member (43) and an arm (44), and a channel (230). The channel (230) is defined at the top of the handle (23) and extends towards the front wall to receive the lever (41) and the bridge member (43), and the cross section of the channel (230) is C-shaped.

The lever (41) comprises a rod (410) and a head (411), and the diameter of the head (411) is bigger than the diameter of the rod (410). The head (411) is received in the channel (230) of the handle (23).

The bridge member (43) comprises a front part (430) and a back part (431), and a neck (432) between the front part (430) and the back part (431). The front part (431) of the bridge member (43) is extended through the slot (221) and inserted to the channel (230) of the handle (23). As each slot (221) is a little wider than the neck (432) of the bridge member (43), the bridge member (43) can sway in the slot (221) to a certain extent and the front part (430) is fixed by being secured in the channel (230) of the handle (23). Two bolt holes (433) are defined through the back part (431), the neck (432) and the front part (430).

The arm (44) has a short branch and a long branch forming an L-shape, and two second holes (440) are defined in the long branch which correspond to the bolt holes (433), whereby two screws are inserted through aligned pairs of the bolt holes (433) and second holes (440) to fix the arm (44) with the bridge member (43). The short branch extends along the side wall of the drawer (20), and a hook (441) with an arcuate edge (4410) is formed at the distal end of the short branch.

The resilient clamp (42) is U-shaped, and a shelf (421) is formed at the top edge of the resilient clamp (42) which is inserted to the recess (225) of the hooked member (224). Two third holes (420) are defined at two side walls of the clamp (42), whereby the rod (410) is inserted through the first hole (222) and the third holes (420) and engages with a screw cap (423) such that the clamp (42) is compressed to achieve a stored energy as an elastic force.

Due to the elastic force of the resilient clamp (42), the head (411) of the lever (41) is pulled to the front wall (22). As the head (411) is received in the channel (230) of the handle (23), the handle (23) is also pulled close to the front wall (22), thus the arm (44) is kept horizontal. The top of the notch (320) is a little lower than the top of the hook (441) of the arm (44).

When the drawer (20) is pushed in, the arcuate edge (4410) touches the bottom board (32). As the bridge member (43) can sway in the slot (221) to a certain extent, the arm (44) also sways to hitch the hook (441) to the notch (320), and the hook (441) will not slide out. The user can push the cabinet (10) freely without being worried about the drawer (20) escaping the cabinet.

Figure 5:
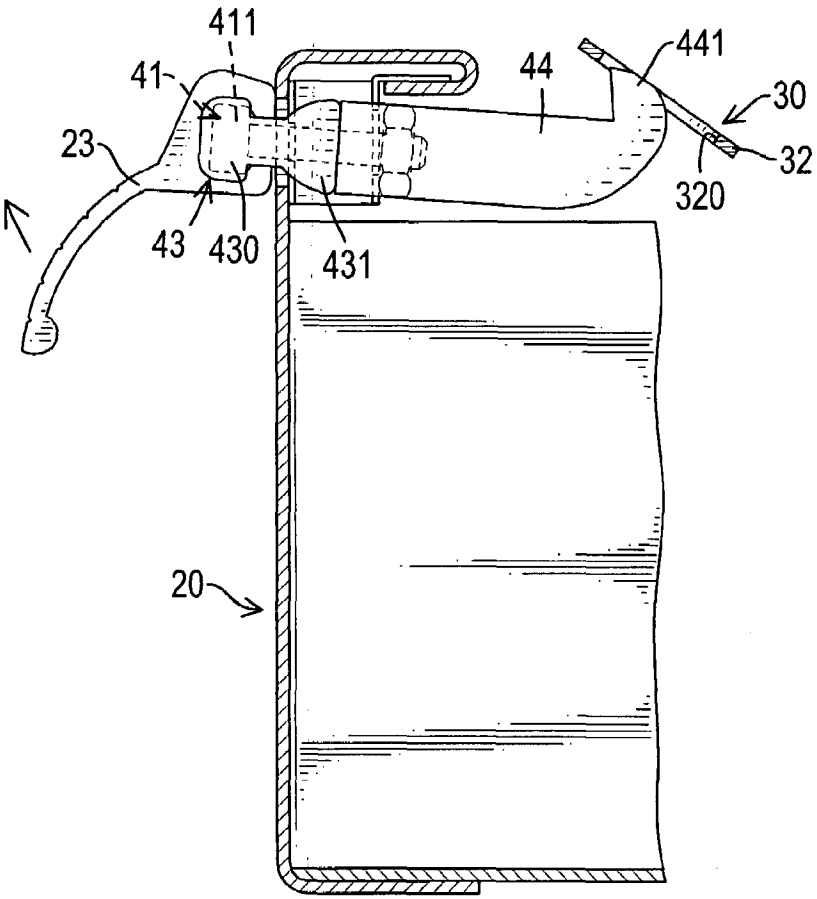
FIG. 5 is a partial view in cross-section showing that the drawer is about to be opened, in accordance with this invention.
Figure 6:
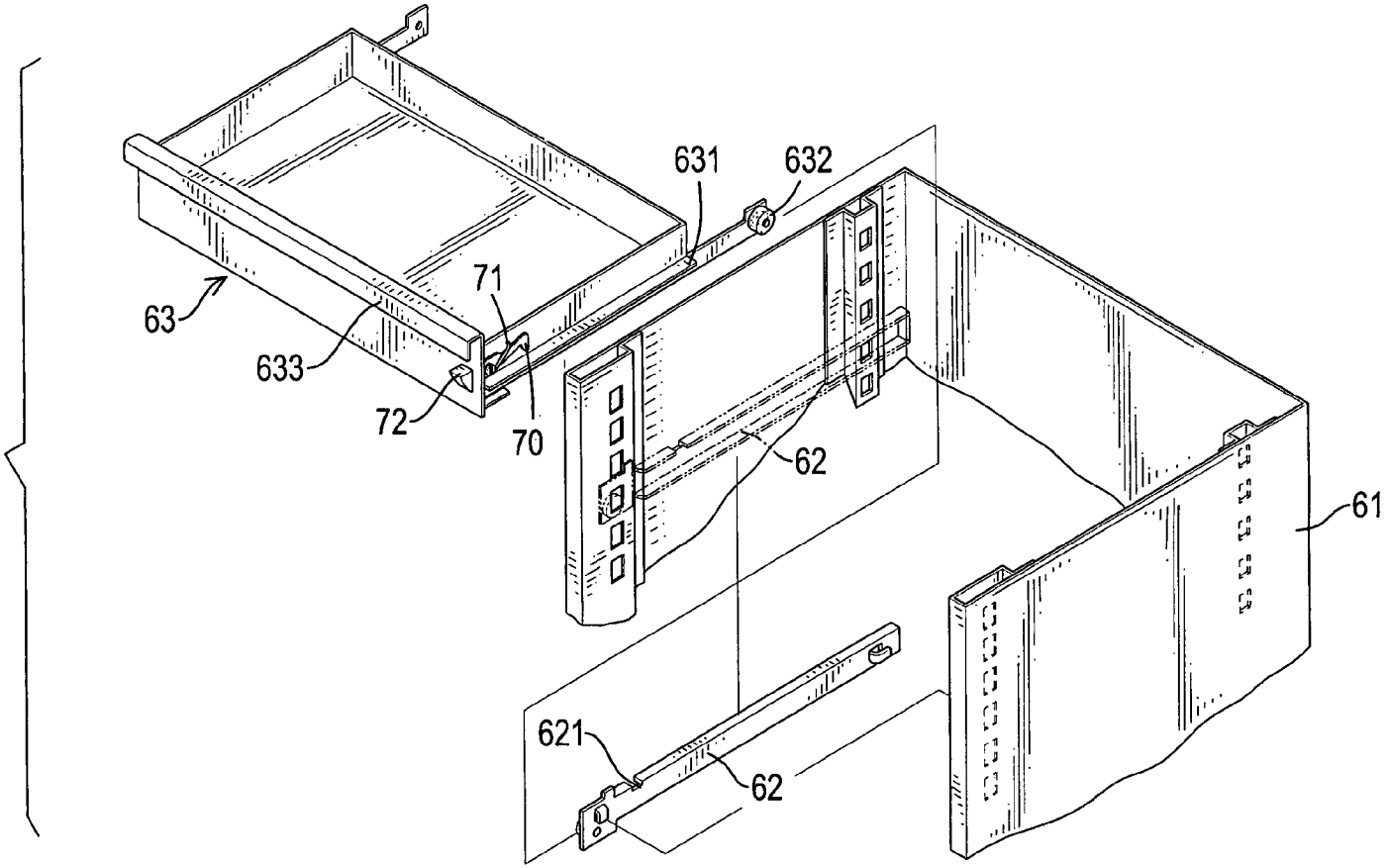
FIG.6 PRIOR ART
FIG. 6 is an exploded view of the conventional tool cabinet.

When the drawer (20) is about to be opened, as shown in FIG. 5, the handle (23) is swayed outward by the user and pivoted on the top of the handle (23), and the bridge member (43), the lever (41) is also pulled outward, then the hook (441) sways downward and escapes from the notch (320), whereby the drawer (20) can be pulled out.

The resilient clamp (42) can also be replaced by a spring or other resilient members, which can form a resilient support inside the front wall (22) to pull the lever (41) and the handle (23) close to the front wall (22).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cabinet comprising;

a body having an open front and two opposite side faces;

multiple slide tracks mounted at inner walls of the opposite side faces;

at least one drawer mounted between two opposite slide tracks of the multiple slide tracks and each one of the at least one drawer comprising two side walls, a front wall and a handle, wherein the front wall is higher than the side walls to form a connection member, and the handle is mounted across the front wall transversely; and a positioning device mounted in the body and comprising at least one locating device corresponding respectively to the at least one drawer, each one of the at least one locating device being mounted between a corresponding drawer and the inner walls of the opposite side faces of the body and comprising:

a fastener attached to the body and having a notch;

at least one slot defined in the front wall of the corresponding drawer;

a bridge member extending through the slot and connected with the handle on the corresponding drawer, and mounted with an arm comprising a long branch and a short branch, wherein a hook with an arcuate edge is formed at a distal end of the short branch the hook being configured to be received in and engaged with the notch in the fastener to retain a drawer in place;

a first hole defined beside the slot;

a lever having a head and a rod, wherein the rod is extended into the first hole and the head is mounted in the handle.

2. The cabinet as claimed in claim 1, wherein a channel is defined at a top of the handle of each one of the at least one drawer, and a cross section of each channel is C-shaped; and the head of the lever of each one of the at least one locating device is securely received in the channel of a corresponding handle.

3. The cabinet as claimed in claim 2, wherein the bridge member of each one of the at least one locating device comprises a front part, a back part, and a neck formed between the front part and the back part, wherein the front part of the bridge member extends through the slot in the corresponding drawer and is secured in the channel of handle on the corresponding drawer.

4. The tool cabinet as claimed in claim 3, wherein the arm of the bridge member of each one of the at least one locating device is L-shaped and is mounted in the back part of the bridge member by screws.

5. The cabinet as claimed in claim 1, wherein the connection member of each one of the at least one drawer extends to an inside of the drawer and a top and a hooked member are formed at a distal end of the top, and a recess is defined therein; the resilient member of each one of the at least one locating device is a resilient clamp, which is U-shaped, a shelf is formed at a top edge of the resilient clamp which is inserted to the slot of the hooked member in a corresponding drawer.

6. The cabinet as claimed in claim 5, wherein the fastener of each one of the at least one locating device comprises a side board and a bottom board and is L-shaped.

7. The cabinet as claimed in claim 6, wherein the bottom board of the fastener of each one of the at least one locating device is tilted with respect to the corresponding drawer.

* * * * *